United States Patent [19]

Carp et al.

[11] 4,198,934

[45] Apr. 22, 1980

[54] SIGNAL AMPLIFICATION MEANS

[75] Inventors: Ralph W. Carp; John F. Slack, both of Newport News, Va.

[73] Assignee: The Bendix Corporation, Southfield, Mich.

[21] Appl. No.: 917,221

[22] Filed: Jun. 20, 1978

[51] Int. Cl.[2] ..... F02B 3/00

[52] U.S. Cl. ..... 123/32 EA; 307/361

[58] Field of Search ..... 123/32 EA, 32 EJ; 330/99, 103; 328/146, 147; 307/360, 361

[56] References Cited

U.S. PATENT DOCUMENTS

| | | | |
|---|---|---|---|
| 3,458,721 | 7/1969 | Maynard | 307/361 |
| 3,458,821 | 7/1969 | Clarridge | 330/99 |
| 3,504,521 | 4/1970 | Luckers | 330/99 |
| 3,652,945 | 3/1972 | Nakane et al. | 328/150 |
| 3,707,950 | 1/1973 | Schlimme | 123/32 EA |
| 3,724,430 | 4/1973 | Adler | 123/32 EA |
| 3,877,025 | 4/1975 | Maio | 307/360 |
| 3,887,875 | 6/1975 | Shearer et al. | 328/168 |
| 3,970,774 | 7/1976 | Bazin et al. | 178/6 |
| 4,032,797 | 6/1977 | Metcalf et al. | 307/360 |
| 4,039,859 | 8/1977 | Horninger | 307/361 |

*Primary Examiner*—Charles J. Myhre
*Assistant Examiner*—P. S. Lall
*Attorney, Agent, or Firm*—Gaylord P. Haas, Jr.; Russel C. Wells

[57] ABSTRACT

In an electronic fuel injection system for internal combustion engines a voltage multiplier is used to amplify a manifold absolute pressure signal by an amplification factor which is related to throttle position. A dc voltage related to throttle position is converted to a digital signal which controls a bilateral switch which in turn regulates the feed back resistance in an operational amplifier thus regulating the operational amplifier amplification factor. The manifold absolute pressure signal is amplified by the operational amplifier. The resultant signal determines the fuel injector open time.

8 Claims, 4 Drawing Figures

SIGNAL AMPLIFICATION MEANS

TECHNICAL FIELD

The present invention relates to improvements in electronic fuel injection means for internal combustion engines and more particularly to means for enhancing a manifold absolute pressure signal in accordance with throttle position so as to provide increased fuel injection in response to increased manifold fluid density.

BACKGROUND ART

Electronic fuel injection systems are unknown which regulate the quantity of fuel provided to an internal combustion engine so that the system fuel delivery schedule exactly meets the requirements of the particular internal combustion engine. Briefly, engine speed and air density are used by the electronic fuel injection system logic circuit to calculate engine-air flow rates since, for a given engine configuration, air flow is proportional to the product of cylinder air density and engine speed. Cylinder air density is equal to the product of manifold air density and engine volumetric efficiency, the latter of which is determined experimentally for each particular engine configuration. It follows that air flow is proportional to the product of manifold air density, engine speed, and engine volumetric efficiency. Fuel flow, then, can be scheduled as any desired function of air flow, by the parameters used to determine air flow, and engine speed. Manifold absolute pressure (MAP), sometimes referred to as manifold air pressure, and air temperature are used to define density.

A throttle position and rate of change of throttle position sensor is also used in known electronic fuel injection systems to provide information to the system control logic to provide modulation of, by small percentages, the basic fuel delivery schedule.

It is known to those skilled in the art that cylinder air density can be approximated as a function of manifold absolute pressure and throttle position. Thus, in electronic fuel injection systems where engine speed is not readily obtainable or for economy purposes an engine speed detector is not desired, the basic system fuel delivery schedule can be calculated in accordance with manifold absolute pressure, throttle position and temperature.

In order to combine signals related to manifold absolute pressure and throttle position nonlinearly, it has been proposed to provide a voltage signal related to throttle position to the gate of a field effect transistor so that the effective resistance through the field effect transistor drain-source circuit varies in accordance with throttle position. A voltage related to manifold absolute pressure is then impressed across a voltage divider which includes the field effect transistor drain-source circuit so that an output voltage is obtained which can be suitably nonlinearly related to manifold absolute pressure and throttle position by proper choice of the system parameters.

SUMMARY OF THE INVENTION

The present invention is an improved means for combining two voltage signals and specifically, for combining signals related to manifold absolute pressure and throttle position. A voltage multiplier comprised of an operational amplifier has a plurality of selectable feed back resistors for changing the amplifier amplification factor. The appropriate feed back resistors are selected through a bilateral switch which operates in response to a digital signal related to throttle position. A throttle position sensor provides a dc voltage related to throttle position with an analog to digital convertor providing the above mentioned digital signal in response to the dc voltage. A dc voltage related to manifold absolute pressure is amplified by the operational amplifier to thus provide multiplication of that voltage by a factor which varies in accordance with throttle position.

It is an object of this invention to provide an improved voltage multiplier.

It is another object that this invention provide an improved voltage multiplier which is adapted for use in an electronic fuel injection system for internal combustion engines.

A further object of the invention is to provide means for use in electronic fuel injection systems for multiplying a voltage related to manifold absolute pressure by a voltage related to throttle position.

These and other objects of the invention become apparent from a reading and understanding of the following description of the invention and drawings, wherein.

DESCRIPTION OF THE PREFERRED EMBODIMENT

Figure 1:
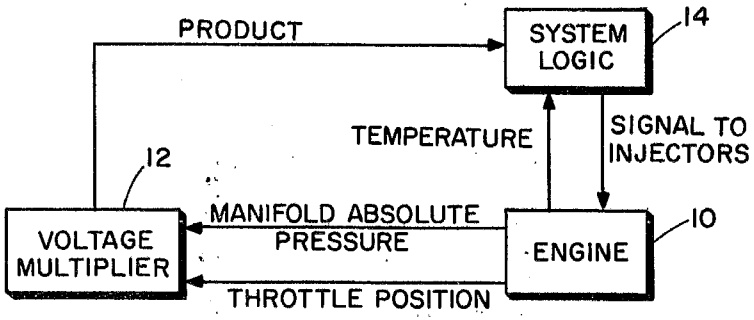
FIG. 1 is a block diagram of an electronic fuel injection system which uses the present invention.

Referring first to FIG. 1, a block diagram of an electronic fuel injection system using the present invention includes an engine 10 having various sensors or transducers (not shown) thereon which provides signals related to various engine or environmental parameters. Included are signals related to manifold absolute pressure which are applied to the voltage multiplier 12 of the present invention and a signal related to manifold air temperature is applied, together with the product signal from multiplier 12 to system logic circuit 14. In response to the various signals applied thereto logic circuit 14 generates signals for controlling the engine such as a signal to the fuel injectors which controls the open time thereof.

Figure 2:
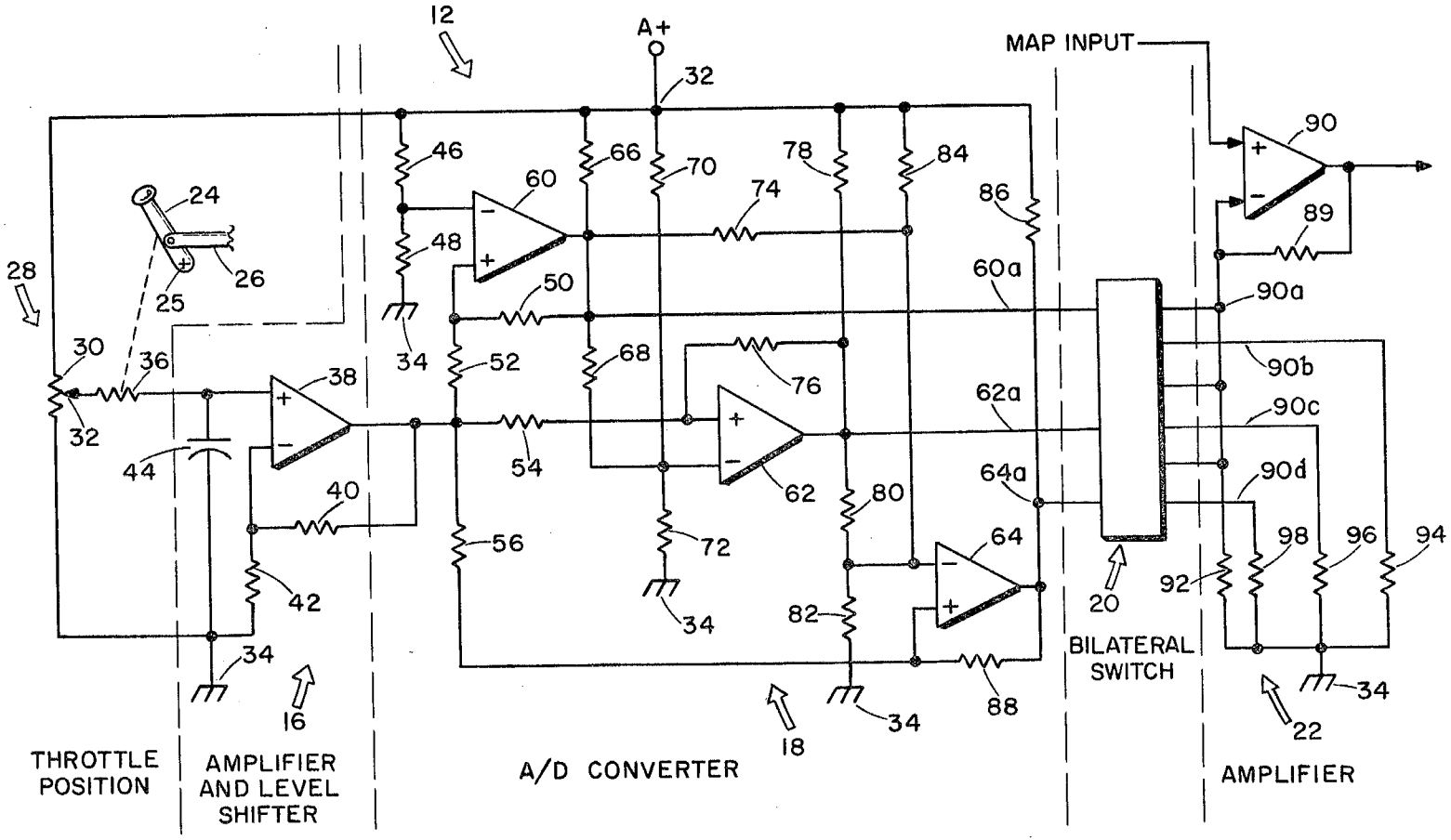
FIG. 2 is a schematic of the invention.

Referring now to FIG. 2 voltage multiplier 12 is seen to be comprised of amplitude and level shifter 16, analog to digital converter 18, a bilateral switch 20 and amplifier 22. A throttle arm 24 is pivoted about axis 25 to actuate a connecting rod 26 which is used to position the throttle plate (not shown) in the engine being controlled so as to adjust the air flow into the engine manifold in the manner known to those skilled in the art. A potentiometer 28 having a winding 30 connected across a source of dc voltage impressed at terminals 32 and 34 and arbitrarily designated as A+ and ground respectively, has a wiper 32 which is mechanically connected to throttle control arm 24 so as to position the wiper along the length of winding 30 in accordance with the position of the engine throttle plate. Wiper 32 is connected through resistor 36 to the input terminal of the amplifier and level shifter 16 and more particularly to the non-inverting input terminal of operational amplifier 38 which includes a feed back resistor 40 connected between its output terminal and its inverting input terminal and a resistor 42 connected between the inverting input terminal and ground. A capacitor 44 connected between operational amplifier 38 and non-inverting input terminal and ground removes alternating voltages from the input terminal. The output signal from amplifier 38 comprises an amplifier and level shifted dc voltage which is related to the position of the engine throttle plate and is connected through resistor 56 to the non-inverting input terminal of operational amplifier 64, through resistor 54 to the non-inverting input terminal of operational amplifier 62 and through resistor 52 to the non-inverting input terminal of operational amplifier 60. Operational amplifiers 60, 64 and 62 are connected as comparators and receive their reference voltages at their respective inverting input terminals through the voltage divider comprised of resistors 46 and 48 in the case of operational amplifier 60, through the voltage dividers comprised of resistors 66, 68, 70 and 72 in the case of operational amplifier 62 and through the voltage divider comprised of resistors 78, 80, 82 and 84 in the case of operational amplifier 64. Resistors 50, 76 and 88 are provided to connect the non-inverting input terminals with the output terminals respectively of operational amplifiers 60, 62 and 64.

Figure 3:
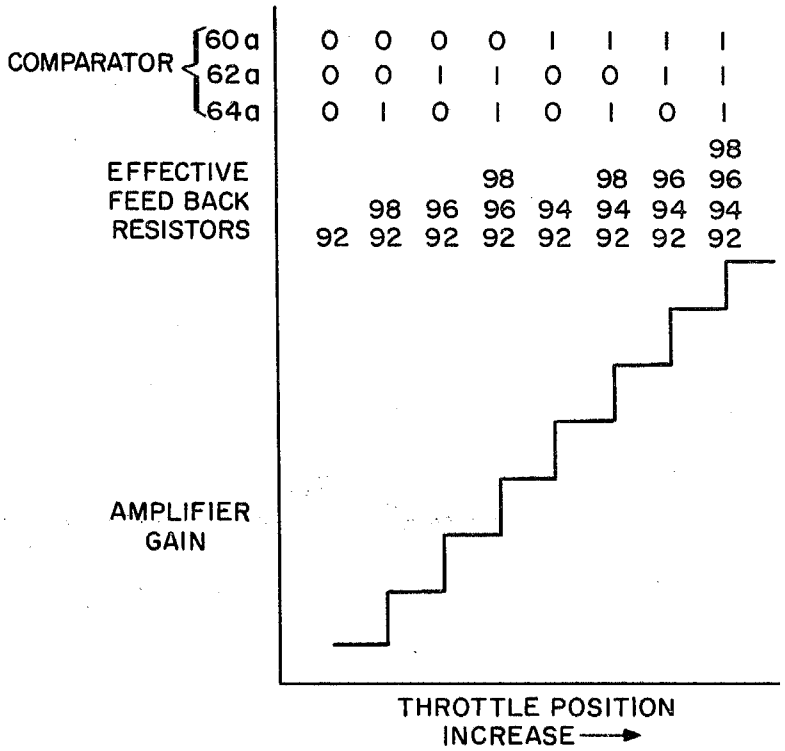
FIG. 3 is a curve of manifold absolute pressure against voltage multiplier output as engine throttle position is varied during typical engine operation.

The circuit is arranged so that as the throttle is increased, the voltage at the output of amplifier 38 increases. In addition, amplifier 60, 62 and 64 are so referenced that comparator 64 is the first to have its referenced voltage exceeded so that it generates an output. Referring now to FIG. 3 wherein an output signal from a comparator is termed a logical "1" it can be seen that at a minimum throttle position the threshold of no comparator is exceeded so that each comparator generates a logical "0" output. As throttle position increases the comparator 64 threshold is exceeded so that it generates a logical "1" output. As throttle position increases further the threshold of comparator 62 is exceeded so that it generates a logical "1" output which is applied not only to bilateral switch 20 but also to the voltage divider comprised of resistors 78, 80 and 82 so that the reference voltage of comparator 64 is suddenly increased and is no longer exceeded by the signal of its non-inverting input terminal. Accordingly, comparator 64 turns off. As throttle position continues to be increased the new signal voltage to comparator 64 is again increased so that eventually both comparators 62 and 64 generate output signals which are applied to bilateral switch 20. A further increase of throttle position causes the reference of comparator 60 to be exceeded, its output signal being applied not only to bilateral switch 20 but also through resistor 74 to the inverting input terminal of operational amplifier 64 and through resistor 68 to the inverting input terminal of operational amplifier 62. This output signal from comparator 60 causes comparators 62 and 64 to turn off. As can be seen with reference to FIG. 3 the aforementioned sequence of signals obtained from the A/D converter 18 of FIG. 2 corresponds to the signals seen in the top portion of FIG. 3, an instantaneous signal from the A/D converter being comprised of the three vertical digits corresponding to the throttle position plotted along the abscissa. The signals generated by the A/D converter 18 continue in eight distinct steps as shown in FIG. 3 as the throttle position traverses the range of its movement.

Figure 4:
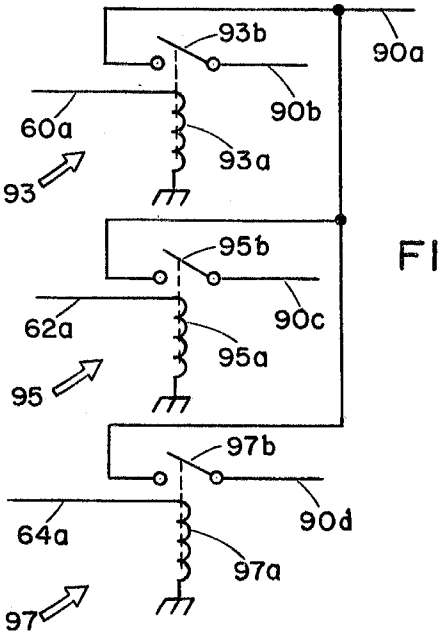
FIG. 4 is a schematic of the equivalent circuit of the bilateral switch 20 of FIG. 2.

An equivalent circuit of bilateral switch 20 is seen in FIG. 4 reference to which figure should now be made. Although preferably bilateral switch 20 is a solid state device its equivalent circuit is comprised in this embodiment of the three relays 93, 95 and 97 having windings and single pole, single throw contacts 93*a* and 93*b*, 95*a* and 95*b*, and 97*a* and 97*b* respectively. The windings are respectively connected between terminals 60*a*, 62*a* and 64*a*, previously seen in FIG. 2, and the voltage return terminal ground. One terminal of each of the relay switches is connected in common with one terminal of each of the other relay switches to terminal 90*a*. The other switch terminals are connected respectively to terminals 90*b*, 90*c* and 90*d*. In the convention adopted for this description of an embodiment of the invention an output signal from a comparator of FIG. 2 causes its associated relay winding to be energized to cause its associated relay switch to be closed, it being understood that the associated switch opens automatically when the winding is unenergized.

Returning now to FIG. 2 it can be seen that amplifier 22 is comprised of an operational amplifier 90 whose non-inverting input terminal is connected to receive the manifold absolute pressure signal and whose inverting input terminal 90*a* is connected through resistor 89 to the amplifier output terminal and also to bilateral switch 20. It can also be seen that the bilateral switch terminals 90*b*, 90*c* and 90*d* are connected respectively to ground through resistors 94, 96 and 98. In addition, terminal 90*a* is connected to ground through resistor 92.

It should now be clear that as throttle position is increased, the circuit operates to shunt feed back resistor 92 with the various other resistors 94, 96 and 98. Specifically, in referring to FIG. 3 the effective feed back resistors as the throttle position is increased include, in addition to resistor 89, the resistor combination seen at FIG. 3 so that at the low range of throttle position resistor 92 is effective, at the next step resistors 92 and 98 are effective, and so forth through the eight digital steps of throttle position as shown in FIG. 3. In this particular embodiment as can also be seen at FIG. 3, the average gain of amplifier 22 increases linearly with throttle position over a certain predetermined range of throttle position.

Having now described this invention, various alterations and modifications thereof should become obvious to one skilled in the art. For example, as should now be clear, the voltage multiplier of this invention can be used to generate various other functions than that described by proper selection of the feed back elements and other circuit parameters. In addition, it can be seen that the number of steps in producing these functions is a mere choice of the designer. Accordingly, the invention is to be limited only by the scope and true spirit of the appended claims.

The invention claimed is:

1. A regulating arrangement for an internal combustion engine having a throttle and manifold comprising:
   - means for generating a first analog electrical signal related to the position of such throttle;
   - means for generating a second analog electrical signal related to the fluid pressure within said manifold;
   - means for generating a digital signal comprised of discrete signal levels related to the instantaneous level of said first analog electrical signal;
   - amplifier means for amplifying said second analog electrical signal including means for varying the amplifier gain in response to said plural discrete signal levels of said digital signal.

2. The regulating arrangement of claim 1 wherein said means for generating a first analog electrical signal comprises a dc voltage source, a potentiometer having a winding across said dc voltage source and a slider ganged to said throttle, said first analog electrical signal being generated on said slider.

3. The regulating arrangement of claim 1 or 2 wherein said means for generating a digital signal comprises an amplifier and a level shifter connected to receive said first analog electrical signal and an analog to digital convertor receiving the output of said amplifier and level shifter.

4. The regulating arrangement of claim 1 or 2 wherein said variable gain amplifier includes an operational amplifier connected at a voltage amplifier and having means for selecting the gain of said voltage amplifier, said means for selecting being responsive said digital signal.

5. The regulating arrangement of claim 4 wherein said means for selecting operates in discrete steps in response to discrete steps in said digital signal.

6. Means for changing the effective magnitude of a first quantity related to the level of a first electrical signal by a second quantity related to the level of a second electrical signal comprising:

means for converting said first electrical signal to a digital signal;

an amplifier comprised of an operational amplifier having a resistive feed back circuit whereby the gain of said amplifier is determined, said resistor feed back circuit having a plurality of selectable discrete resistance values; and, means for selecting a predetermined one of said resistance values in response to a predetermined digital signal, said second electrical signal being connected to one input of said operational amplifier and the other input terminal of said operational amplifier being connected to said feed back circuit for varying the gain of said amplifier in discrete levels.

7. The means for changing of claim 6 including a voltage source wherein said feed back circuit comprises a fixed resistance connected between said other input terminal and the output terminal of said operational amplifier and a plurality of resistances switchably connectable between said other input terminal and one terminal of said voltage source.

8. The means for changing of claim 6 or 7 wherein said means for converting comprises a plurality of voltage comparators at a source of multiple voltage references, one said voltage reference being associated with and providing a threshold reference to an associated comparator and feed back means interconnecting the output terminals of the various comparators for altering the reference on predetermined ones of said comparators in response to an output from another of said comparators, and means for applying said first electrical signal to each said comparator, the collective output signals from said comparators comprising said digital signal.

* * * * *